US007152563B2

(12) United States Patent
Ono et al.

(10) Patent No.: US 7,152,563 B2
(45) Date of Patent: Dec. 26, 2006

(54) OPERATION UNIT OF ENGINE

(75) Inventors: Ryou Ono, Saitama (JP); Takashi Oniwa, Saitama (JP); Satoshi Miyashita, Saitama (JP)

(73) Assignee: Komatsu Zenoah Co., Saitama (JP)

( * ) Notice: Subject to any disclaimer, the term of this patent is extended or adjusted under 35 U.S.C. 154(b) by 0 days.

(21) Appl. No.: 11/228,625

(22) Filed: Sep. 16, 2005

(65) Prior Publication Data

US 2006/0054124 A1 Mar. 16, 2006

(30) Foreign Application Priority Data

Sep. 16, 2004 (JP) ..... 2004-269471

(51) Int. Cl.
*F02N 11/08* (2006.01)

(52) U.S. Cl. ..... 123/179.1; 123/179.3

(58) Field of Classification Search ..... 123/179.1, 123/179.3, 179.2, 339.13, 182.1; 56/10.5, 56/10.8

See application file for complete search history.

(56) References Cited

U.S. PATENT DOCUMENTS 5,524,589 A * 6/1996 Kikkawa et al. ..... 123/396
5,551,395 A * 9/1996 Isaacs et al. ..... 123/339.13
5,611,312 A * 3/1997 Swanson et al. ..... 123/436
5,735,243 A * 4/1998 Asai et al. ..... 123/396

FOREIGN PATENT DOCUMENTS

JP 1-22194 6/1989
JP 7-5233 2/1995

* cited by examiner

*Primary Examiner*—Willis R. Wolfe
*Assistant Examiner*—Johnny H. Hoang
(74) *Attorney, Agent, or Firm*—Everest Intellectual Property Law Group; Michael S. Leonard

(57) ABSTRACT

The invention provides an operation unit of an engine provided with a throttle operating lever operating a throttle valve of the engine from an idle position to a full-open position, two terminals connected to an inner side of a drive circuit of a start motor, a contact element interposed between the terminals and setting a region between both the terminals to a conduction state or a non-conduction state, and a start switch making the region between the terminals conductive or non-conductive, the operation unit further comprising interlocking means for relatively moving a contact position between at least one terminal of the two terminals and the contact element in correspondence to an operation amount of the throttle operating lever, and the terminals and the contact element being brought into contact with each other only at a time when the throttle operating lever is at an idle position.

3 Claims, 7 Drawing Sheets

OPERATION UNIT OF ENGINE

BACKGROUND OF THE INVENTION

1. Field of the Invention

The present invention relates to an operation unit of an engine which can be applied to various working devices provided with a self-starter using an engine as a source of power such as a trimmer, a chain saw, a rotation saw or the like, or a power spreader, various farm working machines or the like, and more particularly relates to an operation unit of an engine based on a simple mechanism which eliminates an erroneous operation of a start switch.

2. Description of the Related Art

An engine provided with a self-starter actuates a start motor by operating a start switch, and starts the engine based on the actuation. A rotation speed of the engine is controlled by operating a throttle lever so as to control an opening degree of a throttle valve via a control wire. When the rotation speed of the engine reaches a predetermined rotation speed, a clutch within a clutch housing engages so as to start an actuation of a rotary blade or the like. When stopping the rotation of the engine, an engine stop switch is turned on. In conventional, the start switch and the engine stop switch are independently provided, however, for example, according to a switch apparatus described in Japanese Utility Model Publication No. 1-22194, a single movable contact having three contact points being provided, the contact is structured such that a pressure button rotating and operating an operation knob and actuating a start switch provided within the operation knob is pressured and actuated to a terminal side, an engine stop switch is changed between a stop position and a working position based on the rotating operation of the knob, and the start switch and the stop switch are composed such that an OFF state, that is, a stop state of the engine is maintained even by pushing the pressure button at a time when the stop switch is at the stop position, and the engine is started by pushing the pressure button only when the stop switch is at the working position.

Further, for example, according to Japanese Utility Model Publication No. 7-5233, the apparatus is structured by a throttle operating lever, a start and stop operating lever, one control wire in which one end thereof is coupled to the throttle operating lever, and an interlocking mechanism controlling an opening degree of the throttle valve, an actuation of a start switch actuating a start motor and an actuation of an engine stop switch controlling an ignition fire and an extinguished fire of the engine in conjunction with a working state of the control wire. Further, a start safety lock lever is arranged near the throttle operating lever. The throttle operating lever, the start and stop operating lever and the start safety lock lever are arranged in a handy operating portion intensively.

The opening degree of the throttle valve of the engine is controlled from an idle position to a full-open position based on the operation of the throttle operating lever. The start and stop operating lever is at a reference position which can be freely operated by the throttle operating lever, and is moved to a stop position locking to the start safety lock lever so as to stop the engine, and is moved further to a start position after canceling the lock by the start safety lock lever so as to start the engine. Further, the one control wire is actuated in correspondence to an operated state of the throttle operating lever and the start and stop operating lever, and the interlocking mechanism controls the opening degree of the throttle valve, the actuation of the start switch actuating the start motor and the actuation of the engine stop switch stopping the engine, interlocking with the working state of the control wire.

According to the engine control apparatus, when operating the throttle operating lever and the start and stop operating lever in accordance with a required procedure, the operation state is transmitted to the interlocking mechanism via the one control wire, the opening degree of the throttle valve, the actuation of the start switch and the actuation of the engine stop switch are controlled by the interlocking mechanism in correspondence to the operation state, and the engine is controlled to a desired start and stop or a desired rotation speed. Further, since the throttle operating lever and the start and stop operating lever are provided in the operating portion in the working machine, and the interlocking mechanism, the start switch and the engine stop switch are provided in the prime mover portion, it is possible to control all of the engine start and stop and the rotation speed by the handy portion. Accordingly, an operability is excellent, an electric wiring to the start switch and the engine stop switch can be simplified, and a connecting line connecting the operating portion and the prime mover portion can be constituted only the one control wire so as to improve an outer appearance.

SUMMARY OF THE INVENTION

Meantime, the composite switch apparatus disclosed in Japanese Utility Model Publication No. 1-22194 mentioned above is structured such that the start switch of the self-starter and the engine stop switch are integrally installed and composed, however, the start switch is turned on by pushing the start button, for example, unless the operating knob for the engine stop switch is rotated to the stop position, so that the engine rotation starts. Accordingly, it is required to make certain of the fact that the operating knob is not at the stop position every time when it is intended to start the engine. Further, according to Japanese Utility Model Publication No. 1-22194 at this time, there is no description which directly associates the operation of the throttle operating lever operating so as to open and close the throttle valve of the engine with the composite switch apparatus as far as determining based on the drawings thereof. Accordingly, even if the throttle operating lever is in the operated state, the working device such as the rotary blade or the like is actuated by pushing the start button as mentioned above.

On the other hand, in accordance with Japanese Utility Model Publication No. 7-5233 mentioned above, there is no risk that the working device or the like is erroneously actuated as far as the throttle operating lever and the start and stop operating lever is not erroneously operated. However, the mechanism and the operating procedure are extremely complicated and troublesome, an accuracy of the parts is required, and it is troublesome to maintain the parts. Further, the erroneous operation tends to be generated in the throttle operating lever and the start and stop operating lever, it is hard to simply start and stop the engine itself, and a smooth operation is expected only by persons of experience in the art.

An object of the present invention is to provide an operation unit which can securely avoid an erroneous operation and an erroneous actuation tending to be generated between the start switch of the self-starter and the throttle operating lever as mentioned above, and in which the start switch and the throttle operating lever are integrally installed, with an extremely simple structure.

The object can be achieved by a basic structure of the present invention, that is, an operation unit of an engine starting and stopping the engine via a start motor and controlling an engine rotation, being characterized by comprising: a throttle operating lever operating a throttle valve of the engine from an idle position to a full-open position; two terminals connected to an inner side of a circuit for driving the start motor; a contact element interposed between the two terminals and setting a region between the two terminals to a conduction state or a non-conduction state; a start switch making the region between the two terminals conductive or non-conductive; interlocking means for relatively moving a contact position between at least one of the two terminals and the contact element in correspondence to an operation amount of the throttle operating lever; and the two terminals and the contact element being arranged at a relative position which is brought into contact with each other only at a time when the throttle operating lever is at an idle position.

According to the basic structure mentioned above of the present invention, when the throttle operating lever is at the idle position, the throttle operating lever is brought into contact with the contact element, and the region between both the terminals is in the conduction state. In the case of operating the throttle operating lever, and moving the lever to a position which is apart from the idle position so as to turn on the start switch, a relative movement is generated between at least one terminal of the start motor and the contact element via the interlocking means, and the contact between the one terminal and the contact element is disconnected. As a result, the region between both the terminals becomes in the non-conduction state, and the start motor is not driven and the engine is not started even if the start switch is operated.

In other words, according to the present invention, the region between the terminals of the start motor is not conducted even if the start switch is operated as far as the operating lever is not at the idle position, so that it is impossible to start the engine. Further, it is preferable that the engine stop switch is installed in the start switch. The engine is not ignited and the engine rotation is stopped, by operating the stop switch, for example, in the case of the stop switch provided with the same structure as that of Japanese Utility Model Publication No. 1-22194 mentioned above, by rotating the operating knob for the stop switch to the stop position.

Preferably, the two terminals are arranged at fixed positions, and the contact element is moved in correspondence to a moving amount of the throttle operating lever via the interlocking means. Alternatively, it is preferable that the contact element is arranged at a fixed position, and the at least one of the two terminals is moved in correspondence to a moving amount of the throttle operating lever via the interlocking means. In this case, it is preferable that the other terminal of the two terminals is arranged at a fixed position, or the structure is preferably made such that the two terminals are moved at the same amount in the same direction. Further, the operation of the throttle operating lever may be constituted of a rotating operation or linear operation in an axial direction of the lever.

The relative motion has an aspect that two terminals are arranged at the fixed positions so as to be immovable as mentioned above, and the contact element is moved via the interlocking means in correspondence to the operation amount of the throttle operating lever. By the movement of the contact element, when the throttle operating lever is actuated and is not at the idle position, two terminals become in the non-contact state, and the region between two terminals becomes in the non-conduction state. Further, as the other relative motion, there is an aspect that the contact element is arranged at the fixed position as mentioned above, and at least one terminal mentioned above is moved via the interlocking means in correspondence to the operation amount of the throttle operating lever. In this aspect, when the throttle operating lever is not at the idle position based on the movement of at least one terminal mentioned above, at least one of two terminals which are brought into contact with the contact element becomes in the non-contact state, and the region between two terminals becomes non-conduction state. As a result, the start motor is not actuated, and the engine is not started, even if the start switch is operated.

As mentioned above, according to the present invention, it is possible to do away with the troublesome operation so as to securely eliminate the erroneous actuation of the engine due to the erroneous operation, and it is possible to secure a further safety, based on the simple structure obtained only by installing the normally used start switch, the throttle operating lever, two terminals of the start motor, the contact element with which these two terminals are simultaneously brought into contact, and the interlocking means as one unit in the single box. The effects which the present invention exerts are considerably great.

DESCRIPTION OF THE PREFERRED EMBODIMENT

A description will be specifically given below of a preferable embodiment in accordance with the present invention based on an illustrated embodiment.

Figure 1:
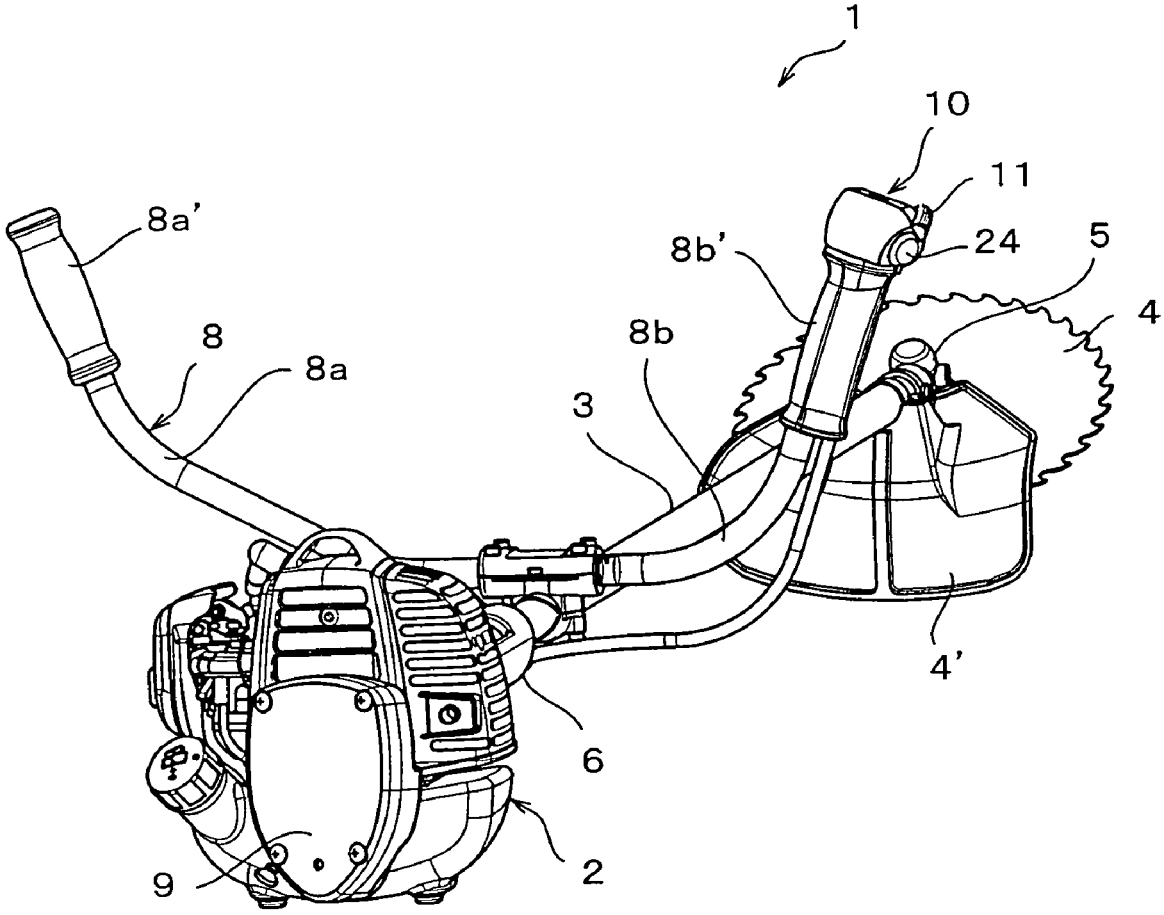
FIG. 1 is a perspective view of a bush cutter to which the present invention is applied, as seen from a back surface side.

FIG. 1 is a bush cutter provided with a self-starter corresponding to a typical embodiment in which an operation unit according to the present invention is attached to a handle portion.

The bush cutter 1 mentioned above is provided with an engine portion 2, a long lever 3 being a long operation lever, and a rotary blade 4. A long driven shaft (not shown) constituted of a metal rod is inserted to the long lever 3, and a base end portion of the long lever 3 is coupled to the rotary blade 4 via a gear housing 5. A bevel gear mechanism (not shown) is arranged in an inner portion of the gear housing 5. On the other hand, a base end portion of the long lever 3 is coupled to the engine portion 2 via a clutch housing (not shown). Further, a grip 6 doubling as a suspended portion suspended to a part of a harness (not shown) is attached to a position adjacent to the clutch housing in a base end portion of the long lever 3. Further, an operating handle 8 of the bush cutter 1 is fixedly provided in adjacent to the rotary blade side corresponding to a front side of the grip 6 doubling as the suspended portion. A main body 9 of a self-starter is fixedly provided in a back face of the engine portion 2. In this case, reference numeral 4' in the drawing denotes a dustproof member.

The operating handle 8 is extended to right and left sides with respect to the long lever 3, and is constituted of a pipe member in which an apical end portion is risen up to an obliquely upper side, and operation grip portions 8*a*' and 8*b*' made of a hard rubber or the like are fixedly provided in apical ends of left and right handles 8*a* and 8*b*. In accordance with an illustrated embodiment, an operation unit 10 of an engine according to the present invention is attached to an upper end of the right operation grip 8*b*'. Operating members such as a throttle operating lever 11, a start switch 24 and the like are attached to the operation unit 10. The operating members are respectively coupled to the engine portion 2 and a start motor (not shown) placed in the main body 9 of the self-starter, via a throttle wire and a lead wire which are not illustrated, and various operations at a time of starting the engine and after starting the engine can be executed by the operating members arranged in the operation unit 10.

FIGS. 2 to 8 show the operation unit 10 corresponding to a first embodiment in accordance with the present invention. The operation unit 10 according to the present embodiment is assembled in a single case 13. The case 13 is constituted of first and second case half bodies 14 and 15 which are divided into two pieces. To the first case half body 14, there are attached a throttle operating lever 11 coupled to a throttle valve (not shown) via a throttle wire (not shown), first and second contact elements 22 and 23 connected to a start motor (not shown) via a lead wire, and a contact element 21 rotating together with a contact element holding member 20 corresponding to an interlocking means in correspondence to a rotating operation of the throttle operating lever 11.

The first case half body 14 is constituted of a rectangular case body in which one surface thereof is open, the mating second case half body 15 and a boss portion 14*a* are provided in a protruding manner in left and right corner portions of one side portion thereof, and a bolt insertion hole 14*b* is formed in an opposite side portion to one side portion to which the boss portion 14*a* protrudes. Center portions of the opposing side wall portions of the other two side portions are respectively notched in a semicircular shape. A diameter of a notch portion 14' notched in the semicircular shape is approximately equal to an outer diameter of the pipe member constituting the handle 8 mentioned above.

One end portion of the throttle operation lever 11 is rotatably supported to a closed wall portion 14*d* of the first case half body 14. Accordingly, a bolt insertion hole (not shown) is formed in the closed wall portion 14*d* of the first case half body 14. The throttle operating lever 11 is entirely formed approximately in a J shape, and a disc portion 11*a* rotating around a bolt portion 11*b* while being in contact with an outer surface of the closed wall portion 14*d* of the first case half body 14 is formed in a rotation support side end portion. Accordingly, the bolt portion 11*b* is integrally formed in a center of the disc portion 11*a* so as to protrude. A rotation side end portion bent perpendicularly in an opposite side to the disc portion 11*a* of the throttle operating lever 11 is guided to an outer surface of an upper peripheral wall portion 14*c* formed as a circular arc surface protruding to the outer side of the first case half body 14 shown in FIGS. 2 and 3 so as to rotate. A stopper 14*c*' defining a rotation limit of the throttle operating lever 11 is provided in a protruding manner in one end portion of an outer surface of the upper peripheral wall portion 14*c*. In the present embodiment, the rotation limit position of the throttle operating lever 11 becomes an idle position.

Figure 2:
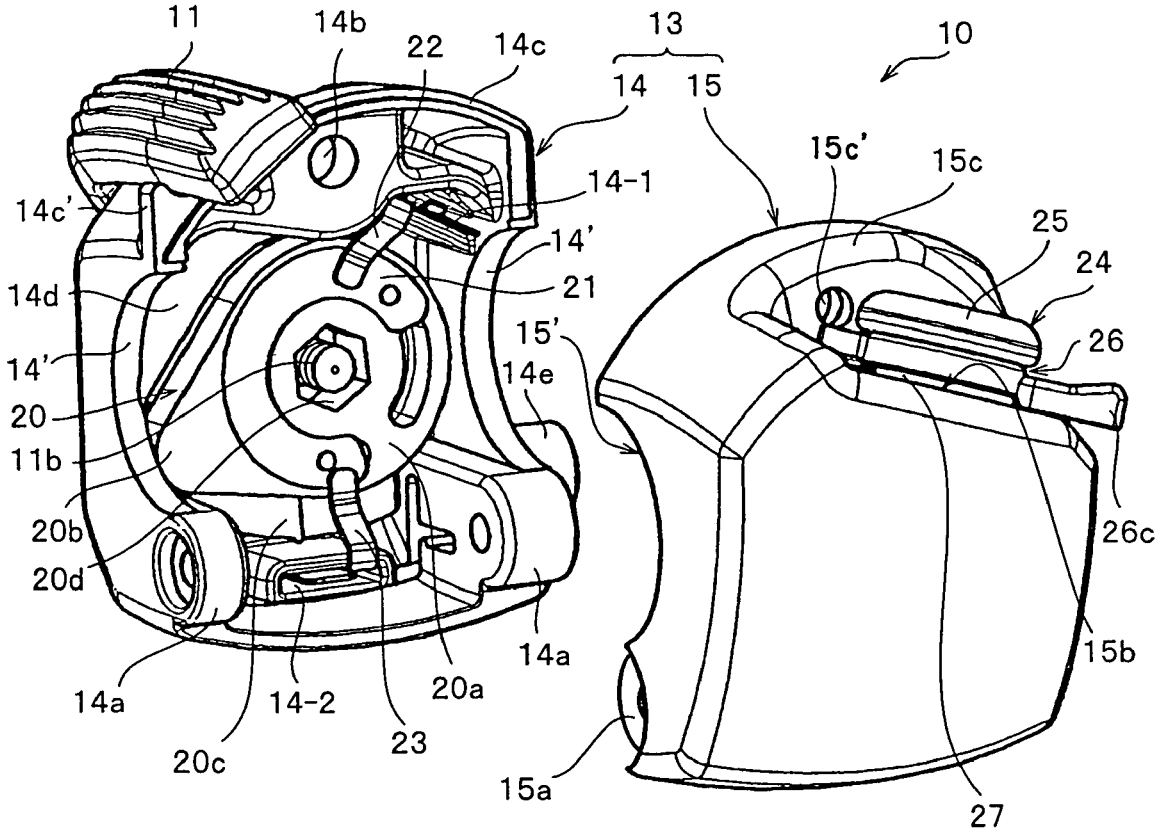
FIG. 2 is an exploded view of an operation unit of an engine according to an embodiment 1 of the present invention.

Further, a contact element holding member 20 rotating around the bolt insertion hole is arranged in an inner surface of the closed wall portion 14*d* of the first case half body 14. The contact element holding member 20 is constituted of a plate material having a shape in which a circular portion 20*a* and an isosceles triangle portion 20*b* formed by two tangent lines of the circular portion 20*a* are integrally combined, and a nut installation hole 20*d* is formed in a center of the circular portion 20*a*. Further, as shown in FIG. 2, a tubular guide portion 20*c* of a throttle wire (not shown) is additionally provided in a curved manner in a lower peripheral wall portion of the circular portion 20*a* and the isosceles triangle portion 20*b* of the contact element holding member 20, one end of the throttle wire is firmly fixed and supported to an inner portion in an apex angle portion side of the isosceles triangle portion 20*b* of the wire guide portion 20*c*, and the other end of the throttle wire is guided by the guide portion 20*c* and a wire guide tube portion 14*e* formed in one side wall of the first case half body 14 so as to be drawn out to an external portion, and is connected to a throttle valve of an engine (not shown).

On the other hand, an approximately C-shaped contact element 21 is firmly fixed to a surface of the contact element holding member 20, which is an opposite side to the closed wall portion 14*d* side of the first case half body 14, in a state of being fitted to a contact element fitting groove formed on a circumference of the circular portion 20*a*. The contact element 21 is formed by a thin member made of a conductive material, one end thereof is arranged on a straight line connecting an apex angle portion peak of the isosceles triangle portion 20*b* of the contact element holding member 20 and a center of the circular portion 20*a*, and the other end is arranged while leaving a space of an approximately 90 degree in a clockwise direction with respect to the one end, as shown in FIG. 2.

Figure 3:
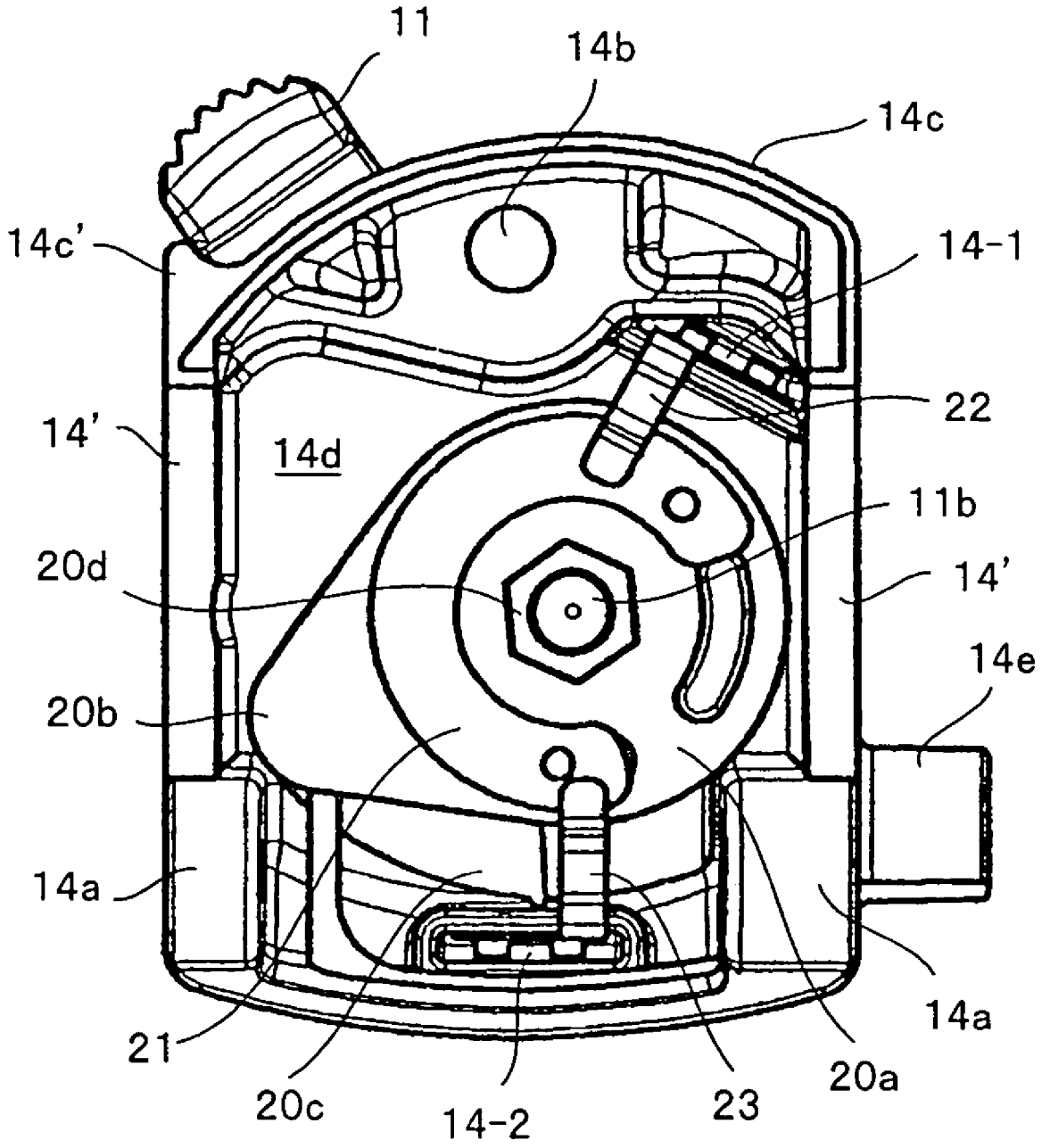
FIG. 3 is a structural view within a unit showing a conduction state at a time when a throttle operating lever is at an idle position.
Figure 4:
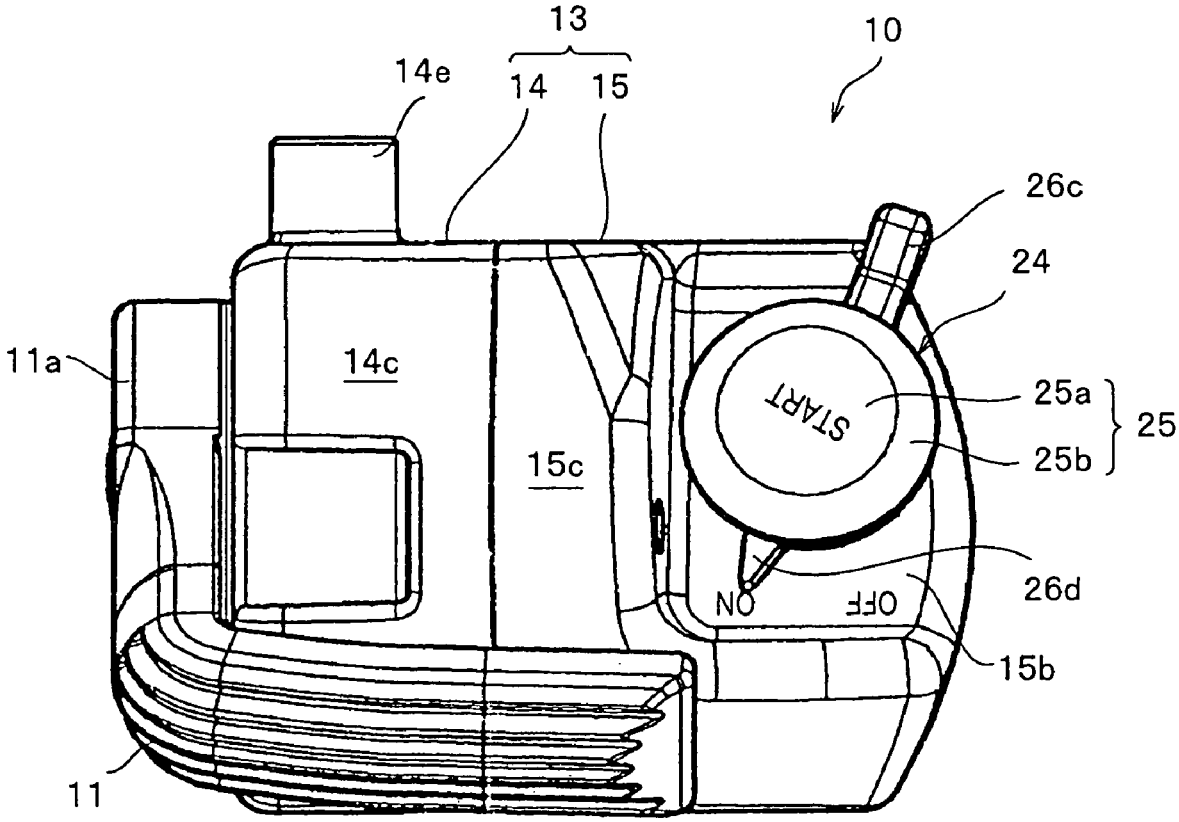
FIG. 4 is a top view of the unit in the same state.
Figure 5:
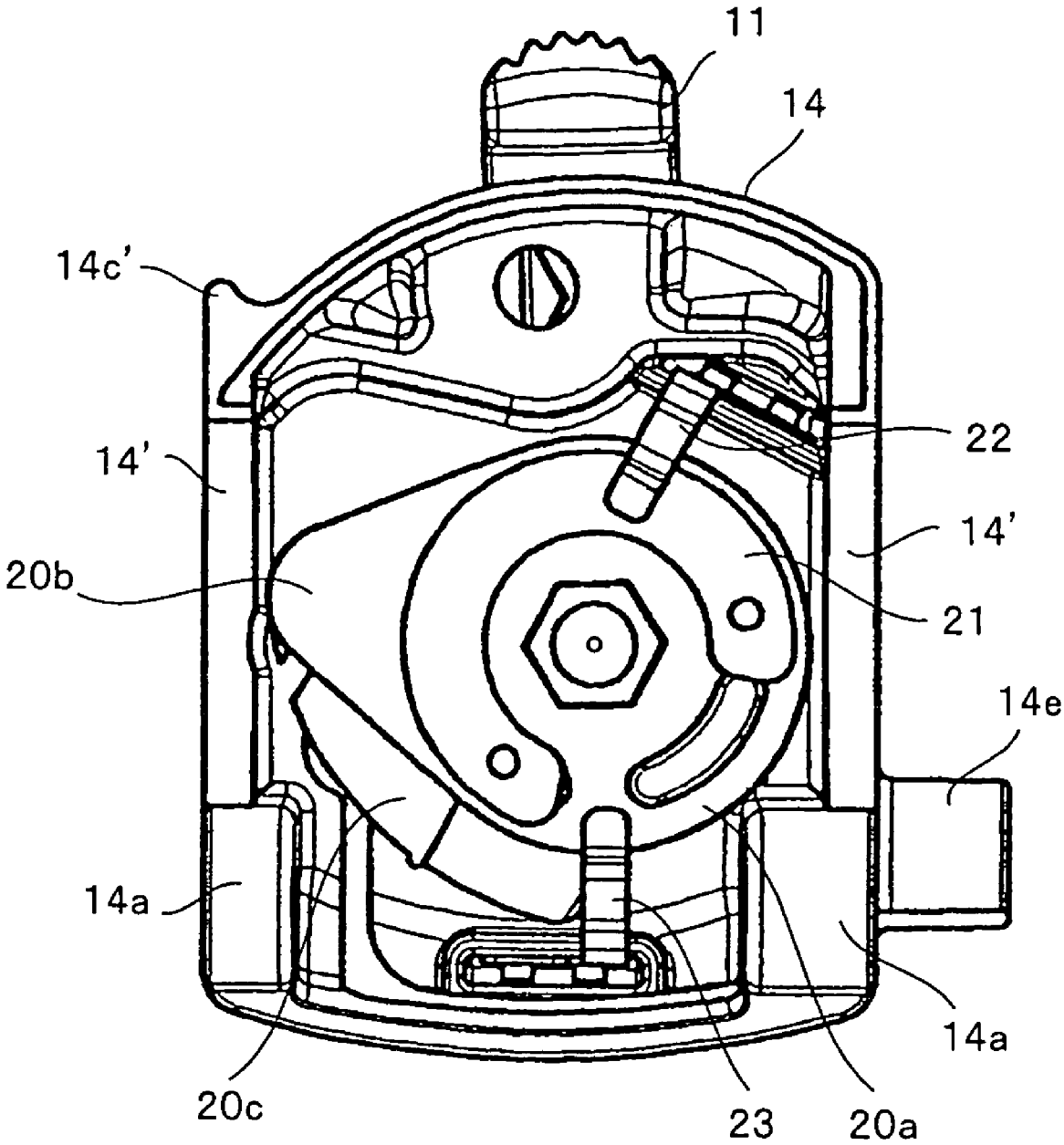
FIG. 5 is a structural view within the unit showing a non-conduction state at a time when the throttle operating lever comes off from the idle position.
Figure 6:
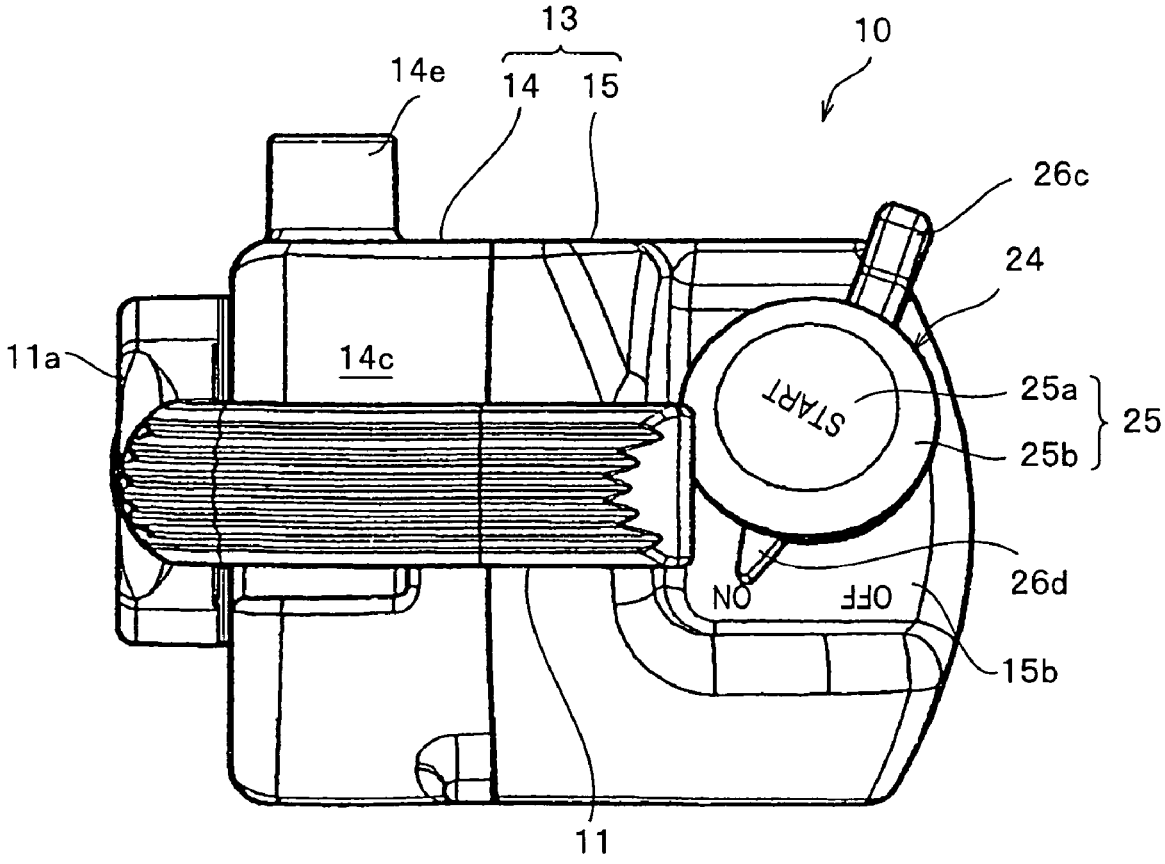
FIG. 6 is a top view of the unit in the same state.

Further, to the first case half body 14, there are attached a pair of first and second contact terminals 22 and 23 in which each end thereof is provided so as to be brought into contact with the C-shaped contact element 21. The first and second contact terminals 22 and 23 have the same shape, one end portion thereof is formed as a hook-shaped end portion attached in such a manner as to be hooked to terminal attachment holes 14-1 and 14-2 formed in the first case half body 14, and the other end portion thereof is constituted of a small plate piece formed in such a manner as to be elastically brought into contact with the contact element 21 via a bent step portion. In FIGS. 2, 3 and 5, the hook-shaped end portion of the first contact terminal 22 arranged in an obliquely upper portion of the first case half body 14 is connected to a pin-shaped terminal member 29 of a push button type start switch 24 mentioned below via a coupling line (not shown), and an end portion of a lead wire (not shown) extending from one terminal of a start motor (not shown) is firmly fixed to the hook-shaped end portion of the second contact terminal 23 arranged in a lower end edge portion of the first half body 14. The start switch 24 is installed in an upper peripheral wall portion 15*c* of the second case half body 15, as shown in FIGS. 2, 4 and 6.

The second case half body 15 is structured such that a boss portion 15*a* connected to the boss portion 14*a* so as to be firmly contacted is formed in a lower portion peripheral wall portion corresponding to the boss portion 14*a* of the first half body 14, and an attachment portion 15*b* of the start switch 24 is formed in the upper peripheral wall portion 15*c* in the opposite side to the boss portion 15*a*. The second case half body 15 is constituted of an approximately rectangular case body which is the same as the first case half body 14 in which one surface in an opposite side to an open surface of the first case half body 14 is open. Since it is necessary that the upper peripheral wall portion 15*c* of the second case half body 15 is brought into surface contact with the upper peripheral wall portion 14*c* of the corresponding first case half body 14, an outer surface thereof is formed by the same circular arc surface as the first case half body 14. A bolt threaded hole 15*c*' is formed at a position corresponding to the bolt insertion hole 14*b* formed in the first case half body 14, in the upper peripheral wall portion 15*c*. On the other hand, it is desirable that the attachment portion 15*b* of the start switch 24 is formed as a flat surface, whereby the switch 24 can be stably attached thereto. Accordingly, a portion in a back face side of the upper peripheral wall portion 15*c* is formed as a horizontal surface via a step, and is set to the attachment portion 15*b* of the start switch 24. Further, the notch portion 15' having the same shape as the semicircular notch portion 14' formed in the first case half body 14 is formed in a center of a peripheral wall portion in which the rotation half portion is formed.

Figure 7:
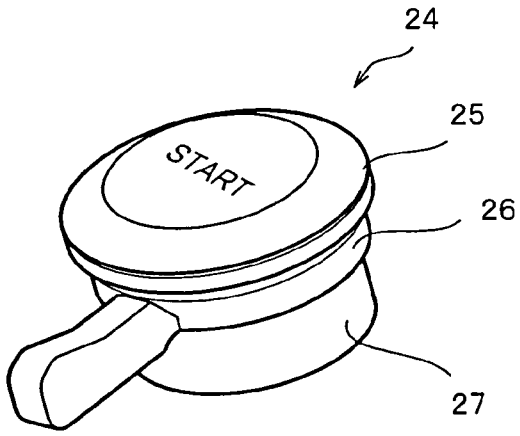
FIG. 7 is a perspective view of an entire showing one example of a start switch attached to the unit.
Figure 8:
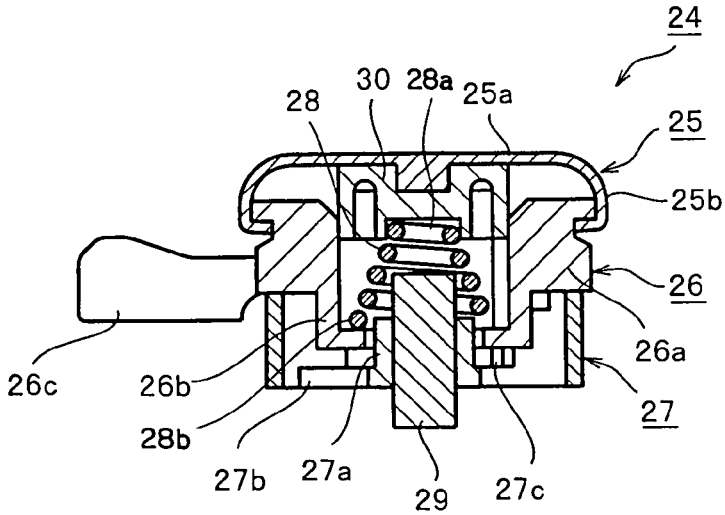
FIG. 8 is a cross sectional view showing an example of an internal structure of the start switch.

FIGS. 7 and 8 show an example of the start switch 24. The start switch 24 is similar to a capped tube body having an open lower surface, a pressure portion 25, an engine stop switch portion 26 and a cylindrical base portion 27 are sequentially arranged in a pressing direction, and a compression spring 28 and a pin-shaped terminal member 29 are arranged in series in hollow portions thereof.

The pressure portion 25 is formed in a cap shape having a peripheral wall portion 25*b* extending toward the pressing direction from a peripheral edge of a disc part 25*a*, and an end portion of the peripheral wall portion 25*b* is bent to an inner side so as to be fixed to the engine stop switch portion 26 so as to be slidable and rotatable. The engine stop switch portion 26 is structured such that a peripheral surface thereof is constituted of a hollow body in which a large-diameter portion 26*a* and a small-diameter portion 26*b* are coupled via a step in a direction of a center line, a rotation knob 26*c* is protruded from a part of the large-diameter portion 26*a*, and an indication projection 26*d* is provided in a protruding manner in an opposite side to the rotation knob 26*c*. On and off positions by the engine stop switch portion 26 are expressed on a leading end rotation circumference of the indication projection 26*d* in the attachment portion 15*b* of the start switch 24. The cylindrical base portion 27 supports a lower face outer peripheral edge portion of the large-diameter portion 26*a* of the engine stop switch portion 26 from a lower side so as to be slidable and rotatable. The cylindrical base portion 27 isfixedlyprovided so as to be fitted to the attachment portion 15*b* of the second case half body 15. A plurality of arm portions 27*b* extending in a radial pattern to an inner peripheral surface of a lower end portion of the cylindrical base portion 27 are integrally formed in the cylindrical base portion 27, while arranging a cylindrical thread portion 27*a* screwing and supporting the pin-shaped terminal member 29 in a center in the lower end opening surface of the cylindrical base portion 27.

The pin-shaped terminal member 29 is screwed into the cylindrical thread portion 27*a*, and an upper end thereof is protruded to an upper side from an upper end of the cylindrical thread portion 27*a*. Further, a lower end of the pin-shaped terminal member 29 is protruded to a lower side from a lower end of the cylindrical thread portion 27*a*. Although an illustration is omitted, to a lower end portion of the pin-shaped terminal member 29, there is firmly fixed the other end of the coupling line constituted of a short normal lead wire (not shown) in which one end is firmly fixed to the hook-shaped end portion of the first contact terminal 22 attached to the obliquely upper portion of the first case half body 14 as already described. A retainer 30 supporting an upper end of the compression spring 28 is attached to the disc part 25*a* of the cap-shaped pressure portion 25, an upper end of the compression spring 28 is fixed to the retainer 30, and a lower end of the compression spring 28 is loaded and fixed to a flange portion 27*c* formed in a peripheral surface of an upper end portion of the cylindrical thread portion 27*a*.

The compression spring 28 is constituted of a small-diameter spiral portion 28*a* and a large-diameter spiral portion 28*b*, an upper end of the small-diameter spiral portion 28*a* is fixed to the retainer 30 arranged in the cap-shaped pressure portion 25, and a lower end of the large-diameter spiral portion 28*b* is fixed to the flange portion 27*c* of the cylindrical thread portion 27*a*. An inner diameter of the small-diameter spiral portion 28*a* is set to be smaller than a diameter of the pin-shaped terminal member 29, and an inner diameter of the large-diameter spiral portion 28*b* is set to be larger than the diameter of the pin-shaped terminal member 29. An end portion of the lead wire extending from the other terminal of the start motor (not shown) is firmly fixed to the large-diameter spiral portion 28*b* of the compression spring 28. As is already mentioned, since the end portion of the lead wire extending from one terminal of the start motor (not shown) is firmly fixed to the hook-shaped end portion of the second contact terminal 23, an electric power from a battery is supplied to the start motor if the compression spring 28 and the pin-shaped terminal member 29 are brought into contact with each other and the first and second contact terminals 22 and 23 are brought into contact with the C-shaped contact element 21, whereby the start motor is driven.

In accordance with the start switch 24 having the structure mentioned above, the cap-shaped pressure portion 25 and the engine stop switch portion 26 are normally at the upper positions due to a spring force of the compression spring 28, and are moved to the lower side together with the retainer 30 by pressing the cap-shaped pressure portion 25 against the spring force of the compression spring 28. When the start switch 24 is in the normal state, the upper end portion of the pin-shaped terminal member 29 inserted to the inner portion of the compression spring 28 exists in the inner portion of the large-diameter spiral portion 28*b* of the compression spring 28 in a non-contact state, and does not reach the small-diameter spiral portion 28*a*. In this case, when pushing the cap-shaped pressure portion 25, the compression spring 28 is compressed and the small-diameter spiral portion 28*a* is moved in the pushing direction. By this movement, the upper end portion of the pin-shaped terminal member 29 is brought into contact with the small-diameter spiral portion 28*a*.

On the other hand, the engine stop switch portion 26 is guided by the lower end edge of the cap-shaped pressure portion 25 around the center axis line of the start switch 24 so as to be independently rotated, by operating the rotation knob 26*c*. By the rotation, an ignition coil of an ignition circuit becomes in a connection state or a disconnection state, and set a spark plug to an ignition fire state or an extinguished fire state. Under the ignition fire state, the apical end of the indication projection 26*d* of the engine stop switch portion 26 indicates an indication position ON expressed in the start switch attachment portion 15*b*, as shown in FIG. 6, and under the extinguished fire state, the apical end of the indication projection 26*d* indicates an indication position OFF.

Further, the engine operation unit 10 according to the embodiment 1 of the present invention provided with the structure mentioned above is fixedly provided, for example, in any (the right operation grip portion 8*b*' in the illustrated embodiment) of the operation grip portions 8*a*' and 8*b*' arranged in the apical end portion of the operation handle 8 of the bush cutter 1, as already mentioned. In order to achieve the fixedly provision, the first and second case half bodies 14 and 15 are firmly contacted by the boss portion 15*a*, and are closed in such a manner as to sandwich a pipe portion protruding from the apical end of the operation grip portion 8*b*' so as to be exposed between the semicircular notch portions 14' and 15' formed in the first and second case half bodies 14 and 15. Thereafter, they are fastened and fixed by inserting a fastening bolt (not shown) to the bolt insertion hole 14*b* formed in the first case half body 14 and screwing the bolt into the bolt thread hole 15*c*' formed in the second case half body 15.

When it is intended to start the engine, if the engine stop switch portion 26 is at the OFF position, the engine is not started even by pushing the start switch 24. In this case, the structure is made such that the indication projection 26*d* indicates the ON position by rotating the engine stop switch portion 26. In this state, it is possible to start the engine by pushing the start switch 24. However, in accordance with the present embodiment, the indication projection 26*d* simply indicates the ON position, and the engine is not always started necessarily only by pushing the start switch 24.

In other words, according to the present embodiment, it is possible to start the engine by pushing the start switch 24 at a time when the throttle operation lever 11 is at the idle position, however, in the case that the throttle valve is open at an opening degree equal to or more than an idle opening degree at which the throttle opening lever 11 is at the other position, the circuit of the start motor is disconnected, the electricity is not conducted even by pushing the start switch 24, and it is impossible to start the start motor. Accordingly, the structure is made such that the engine can not be started. As a result, in the case that the throttle operating lever 11 is at the other position than the idle position, the working devices actuated by the engine rotation is not actuated. Accordingly, the working devices are not carelessly actuated.

A description will be specifically given of this matter by reference to FIGS. 3 and 5. In the case that the throttle operating lever 11 is brought into contact with the stopper 14*c*' defining the idle position of the upper peripheral wall portion 14*c* of the first case half body 14 as shown in FIG. 3, the first contact elements 22 and 23 are brought into contact with the C-shaped contact element 21 firmly fixed to the contact element holding member 20 corresponding to the interlocking means in accordance with the present invention. In the case of pushing the start switch 24 under this state, the upper end portion of the pin-shaped terminal member 29 is brought into contact with the small-diameter spiral portion 28*a* of the compression spring 28 arranged within the start switch 24 as already described, and the start motor circuit is conducted. As a result, the start motor (not shown) is driven, and starts the engine (not shown). In this case, when rotating the throttle operation lever 11 to a position shown in FIG. 5, the contact element holding member 20 is also rotated, the second contact terminal 23 is relatively moved to the open position of the C-shaped contact element 21, the circuit of the start motor becomes in the non-conduction state due to the disconnection of the contact of the C-shaped contact element 21, and the rotation of the start motor is stopped. At this time, the engine keeps on rotation at a predetermined rotation speed.

When rotating the throttle operating lever 11 in the clockwise direction in FIG. 2 from the idle position, a throttle wire (not shown) within the tubular wire guide portion 20*c* additionally provided in the contact element holding member 20 is drawn via the wire drawing portion 14*e* of the first case half body 14 in correspondence to a rotation amount of the throttle operating lever 11, and increases the opening degree of the throttle valve (not shown) so as to increase the engine speed, via the contact element holding member 20. In the case that the work is finished and the engine is stopped, the engine is immediately stopped by operating the operation knob 26*c* of the start switch 24 so as to set the engine stop switch portion 26 to the OFF position. Even if the engine stop switch portion 26 is set to the ON position, and the start switch 24 is pushed in a state in which the throttle operating lever 11 is rotated to the position shown in FIG. 5, the start motor circuit is not conducted because the second contact element 23 is not brought into contact with the C-shaped contact element 21, so that the start motor is not driven and the engine is not started. At this time, the first contact element 22 is brought into contact with the C-shaped contact element 21.

As it could be understood from the description mentioned above, according to the operation unit of the engine based on the present invention, since the throttle operating lever and the start switch including the engine stop switch are installed within the single case so as to be unitized, it is not necessary that the throttle operating lever, the engine stop switch and the start switch are provided in the machine body in the separated manner, and the unit can be attached intensively in the handy handle portion. Accordingly, it is possible to easily carry out the operation itself of the working devices. Further, particularly, in accordance with the present invention, since the start switch is effective in the case that the throttle operating lever is at the idle position, the engine is not started even if the start switch is operated in the state in which the throttle operating lever is moved, so that it is possible to securely eliminate the erroneous actuation caused by the erroneous operation without paying any specific attention, and it is possible to secure a further safety.

In this case, the present invention is not limited to the embodiment mentioned above, for example, the shapes, the connection and disconnection structure of the contact element holding member 20, the C-shaped contact element 21 and the first and second contact terminals 22 and 23 which correspond to the interlocking means, or the layout relation thereof, the attachment structure of the throttle wire and the like can be appropriately changed within the scope of claims.

What is claimed is:

1. An operation unit of an engine starting and stopping the engine via a start motor and controlling an engine rotation, wherein the operation unit comprises:

a throttle operating lever operating a throttle valve of the engine from an idle position to a full-open position;

two switches connected in series inside a circuit for driving the start motor, wherein one of the switches comprises two terminals comprising a first contact terminal connected to the start motor and a second contact terminal separating from the first contact terminal, and a contact element interposed between the two terminals and setting the two terminals to a conduction state or a non-conduction state; and another switch comprises a start switch making a connection between the second contact terminal and the start motor conductive or non-conductive;

interlocking means for relatively bringing together at least one of the two terminals and the contact element or for relatively making the one of the two terminals and the contact element separated in correspondence to an operation amount of the throttle operating lever so that the one of the two terminals and the contact element are made conductive or non-conductive; and the contact element being arranged at a contact position wherein the two terminals are made conductive by the interlocking means at a time when the throttle operating lever is at the idle position.

2. The operation unit of the engine according to claim 1, wherein the two terminals are arranged at fixed positions, and the contact element is moved in correspondence to a moving amount of the throttle operating lever via the interlocking means.

3. The operation unit of the engine according to claim 1, wherein the contact element is arranged at a fixed position, and the at least one of the two terminals is moved in correspondence to a moving amount of the throttle operating lever via the interlocking means.

* * * * *